US008403697B2

(12) United States Patent
Fukamachi et al.

(10) Patent No.: US 8,403,697 B2
(45) Date of Patent: Mar. 26, 2013

(54) SPACE EFFICIENT LEVER CONNECTOR

(75) Inventors: Makoto Fukamachi, Yokkaichi (JP); Takatoshi Katsuma, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 209 days.

(21) Appl. No.: 12/958,658

(22) Filed: Dec. 2, 2010

(65) Prior Publication Data

US 2011/0143571 A1 Jun. 16, 2011

(30) Foreign Application Priority Data

Dec. 10, 2009 (JP) ..... 2009-280102

(51) Int. Cl.
*H01R 13/62* (2006.01)
*H01R 13/64* (2006.01)

(52) U.S. Cl. ..... 439/372; 439/157

(58) Field of Classification Search ..... 439/345, 439/372, 157

See application file for complete search history.

(56) References Cited

U.S. PATENT DOCUMENTS 5,330,362 A * 7/1994 Ito et al. ..... 439/157
5,344,194 A * 9/1994 Hatagishi et al. ..... 285/26
7,396,240 B2 * 7/2008 Frederiksen et al. ..... 439/157

FOREIGN PATENT DOCUMENTS

JP 2008-027787 2/2008

* cited by examiner

*Primary Examiner* — Hae Moon Hyeon

(74) *Attorney, Agent, or Firm* — Gerald E. Hespos; Michael J. Porco; Matthew T. Hespos

(57) ABSTRACT

A lever connector that exhibits excellent space efficiency is provided. The lever connector includes female and male housings that are engageable with each other. A lever is mounted displaceably on the male housing and can be moved between an initial position and a fitting position. A cam groove is formed on the lever, and a cam follower is formed on the female housing. An entrance of the cam groove is aligned in a direction that intersects the fitting direction of the housings when the lever is at the initial position, and the female housing is assembled into a hood along the same direction.

7 Claims, 11 Drawing Sheets

SPACE EFFICIENT LEVER CONNECTOR

BACKGROUND OF THE INVENTION

1. Field of the Invention

The invention relates to a lever connector.

2. Description of the Related Art

JP-A-2008-27787 discloses a conventional lever connector with first and second housings that are engageable with each other. A lever is mounted on the first housing for rotation between an initial position and a fitting position. A cam groove is formed on the lever, and a cam follower projects from the second housing. The first and second housings are engaged slightly while holding the lever at the initial position. Thus, the cam follower is introduced into the cam groove. The lever then is rotated toward the fitting position. As a result, the cam follower is moved slidably on a surface of the cam groove so that a cam action is exerted between the lever and the second housing. Accordingly, it is possible to bring the first and second housings into the fitting engagement with a low manipulation force.

In the above-mentioned conventional lever connector, when the lever is at the initial position, the entrance of the cam groove is directed toward a front of the first housing, which is a fitting direction of the first and second housings, and the second housing is inserted into a hood from of the first housing from the front. However, the second housing cannot be assembled from the front if there is a space restriction, such as a part in front of the first housing.

The present invention has been made in view of the above-described circumstances, and it is an object of the invention to provide a lever connector that exhibits excellent space efficiency.

SUMMARY OF THE INVENTION

The invention relates to a lever connector with first and second housings that are engageable with each other. A lever is mounted on the first housing in a displaceable manner between an initial position and a fitting position. A cam groove is formed on the lever and a cam follower is formed on the second housing. The cam follower is introduced into the cam groove from an entrance of the cam groove by bringing the first and second housings into slight fitting engagement while holding the lever at the initial position. The cam follower is moved slidably on a groove surface of the cam groove by displacing the lever toward the fitting position. Thus, the first and second housings are brought into a normal fitting position due to a cam action exerted by the slide movement of the cam follower. The entrance of the cam groove is arranged in a direction that intersects the fitting direction of the first and second housings when the lever is at the initial position. Thus, the assembling direction of the second housing to the first housing intersects the fitting direction of the housings. Accordingly, a large assembling space is unnecessary in the fitting direction of the housings so that space efficiency is enhanced.

The first housing may have a hood that can receive the second housing. A cutaway portion may be formed in the hood and opens toward an assembling side of the second housing. A receiving portion that receives the second housing in a contacting manner may be formed on the hood at a position where the receiving portion faces an open face of the cutaway portion of the hood. Thus, the connector can be small in the fitting direction.

A tab of a male terminal fitting may project into the hood, a restriction may project on the second housing and an interference portion may be formed on the cutaway portion. The restriction contacts the interference portion when the second housing is inclined from a normal assembled posture. Thus, engagement of the second housing in the inclined posture into the inside of the hood is restricted.

The cutaway portion is formed on the hood and the tab of the male terminal fitting projects inside of the hood. Thus, there is a possibility that the inclined second housing will break or damage the tab. However, the restriction contacts the interference portion to restrict insertion of the inclined second housing into the hood and to prevent the tab from being broken or damaged.

A guide groove may be formed on the hood at a position contiguous with the interference portion and may extend in the fitting direction. The restriction may slide on the guide groove in the fitting engagement of the first and second housings. Thus, a smooth fitting engagement of the first and second housings is ensured. Additionally, the second housing is simplified as compared to a case where a dedicated guide means is provided in addition to the restriction.

The lever may be arranged in a raised manner to project from the first housing and the entrance of the cam groove may be directed toward a lever projecting side when the lever is at the initial position. Thus, a space on the lever projecting side is used efficiently so that the connector exhibits excellent space efficiency.

DETAILED DESCRIPTION OF THE PREFERRED EMBODIMENT

A connector according to the invention has a male connector and a female connector that are engageable with each other. The female connector has a female housing 10 and the male connector has a male housing 30 and a lever 60. Ends of the connectors that are engaged with each other are referred to as the front ends herein.

Figure 6:
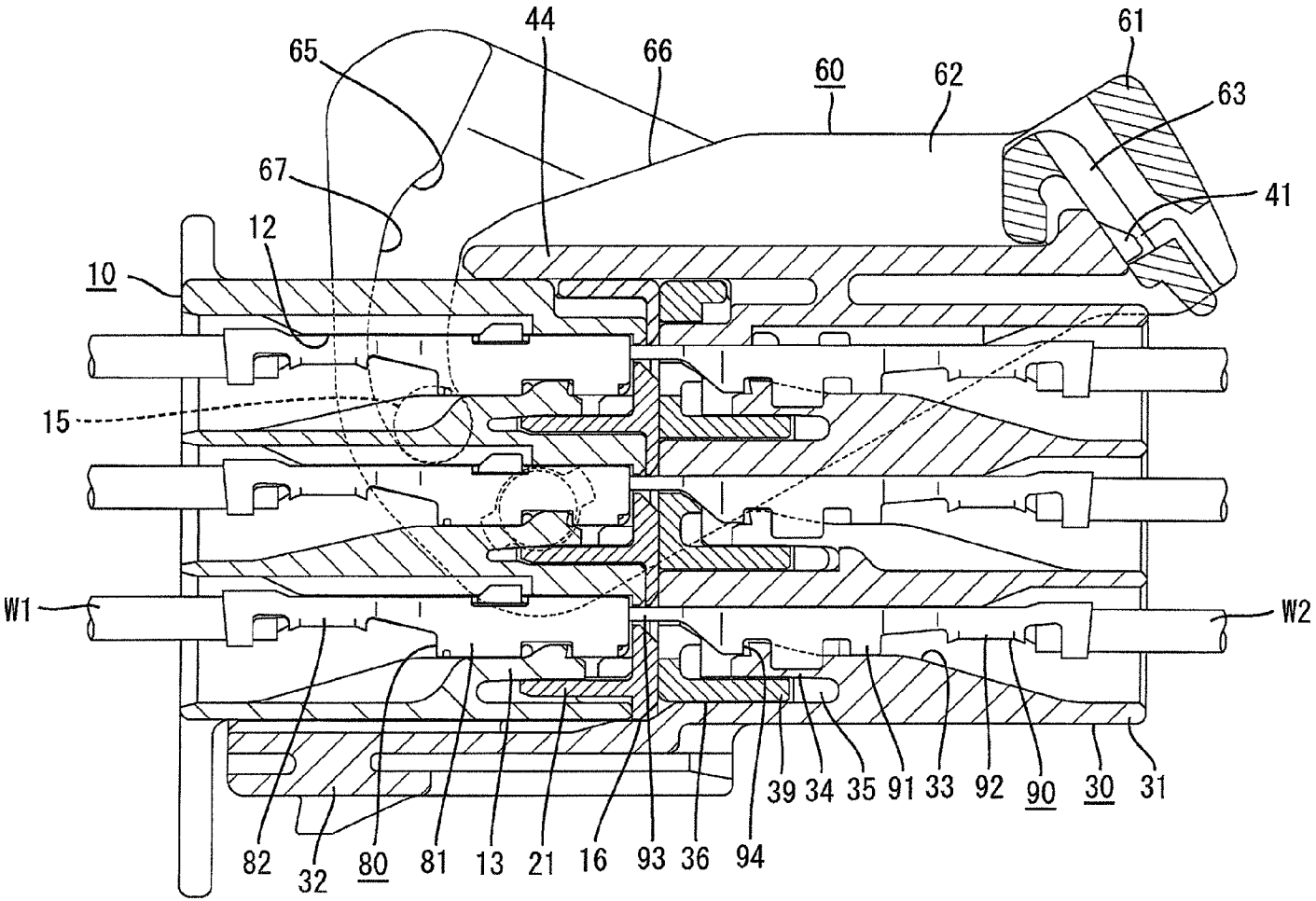
FIG. 6 is a cross-sectional view of the connector showing a state where both housings are in the fitting position.
Figure 9:
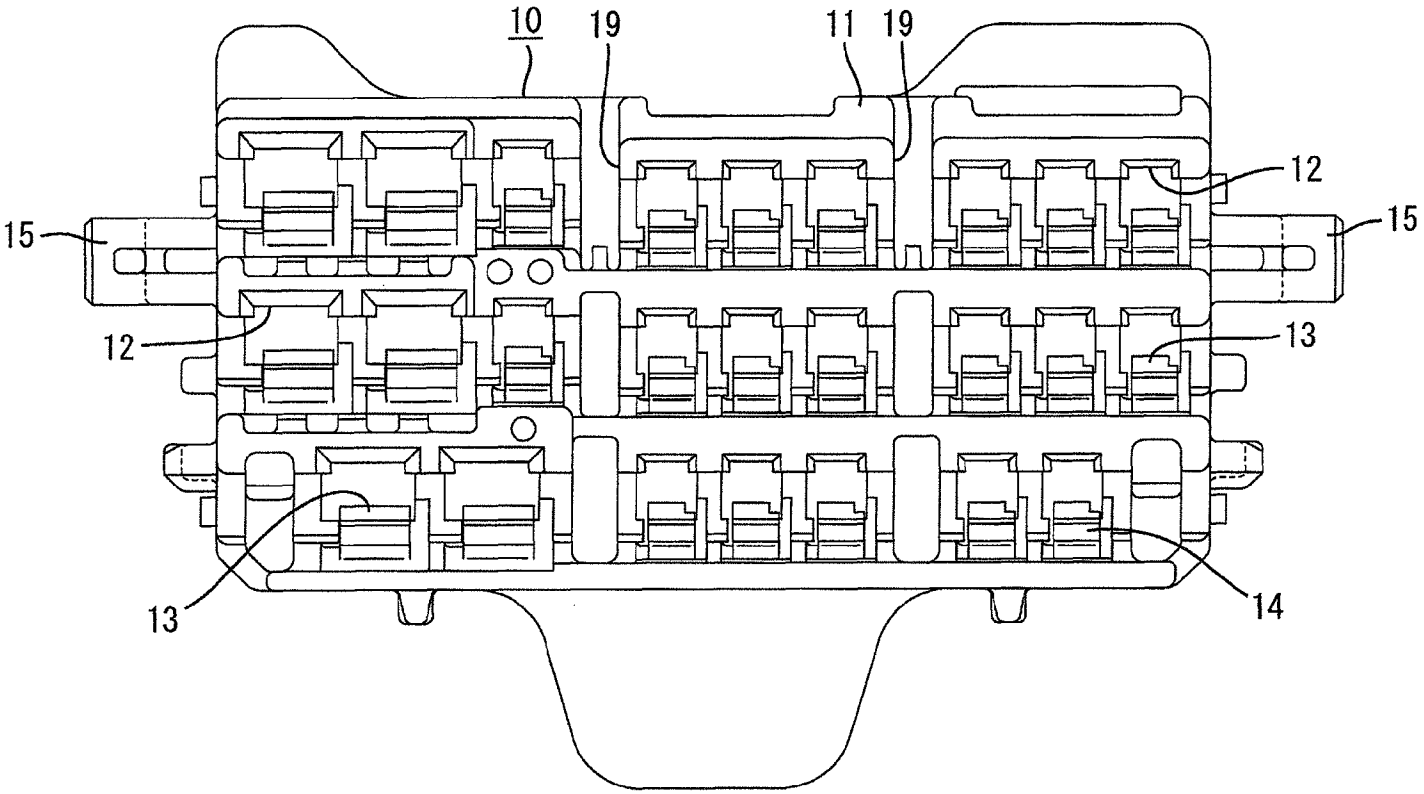
FIG. 9 is a front view of a female connector before a front retainer is mounted on the female connector.

The female housing 10 is made of a synthetic resin, and includes a quadrangular-block-shaped female housing body 11, as shown in FIG. 9. Cavities 12 extend longitudinally through the female housing body 11 and a deflectable lance 13 projects forwardly in each cavity 12. A deflection space 14 is formed below each lance 13 and opens at a front surface of the female housing body 11. As shown in FIG. 6, a female terminal fitting 80 is inserted into the inside of each cavity 12 from the rear and the lance 13 prevents removal of the properly inserted female terminal fitting 80.

The female terminal fitting 80 is formed by bending or otherwise forming a unitary conductive metal plate to define a quadrangular sleeve-shaped body 81 and a barrel 82 that is contiguous with a rear end of the body 81. The barrel 82 is connected to an end portion of an electric wire W1 by caulking, and the electric wire W1 is guided to the outside of the female housing body 11 from a rear-end opening of the cavity 12. A tab 93 of a male terminal fitting 90 is inserted into the body 81 from the front when the housings 10, 30 are fit together so that the female terminal fitting 80 and the male terminal fitting 90 are connected.

Left and right cam followers 15 project from the side surfaces of the female housing body 11. The cam followers 15 have substantially columnar shapes and are disposed substantially centrally on the side surfaces of the female housing body 11 in the longitudinal direction and slightly above center in the height direction.

Figure 10:
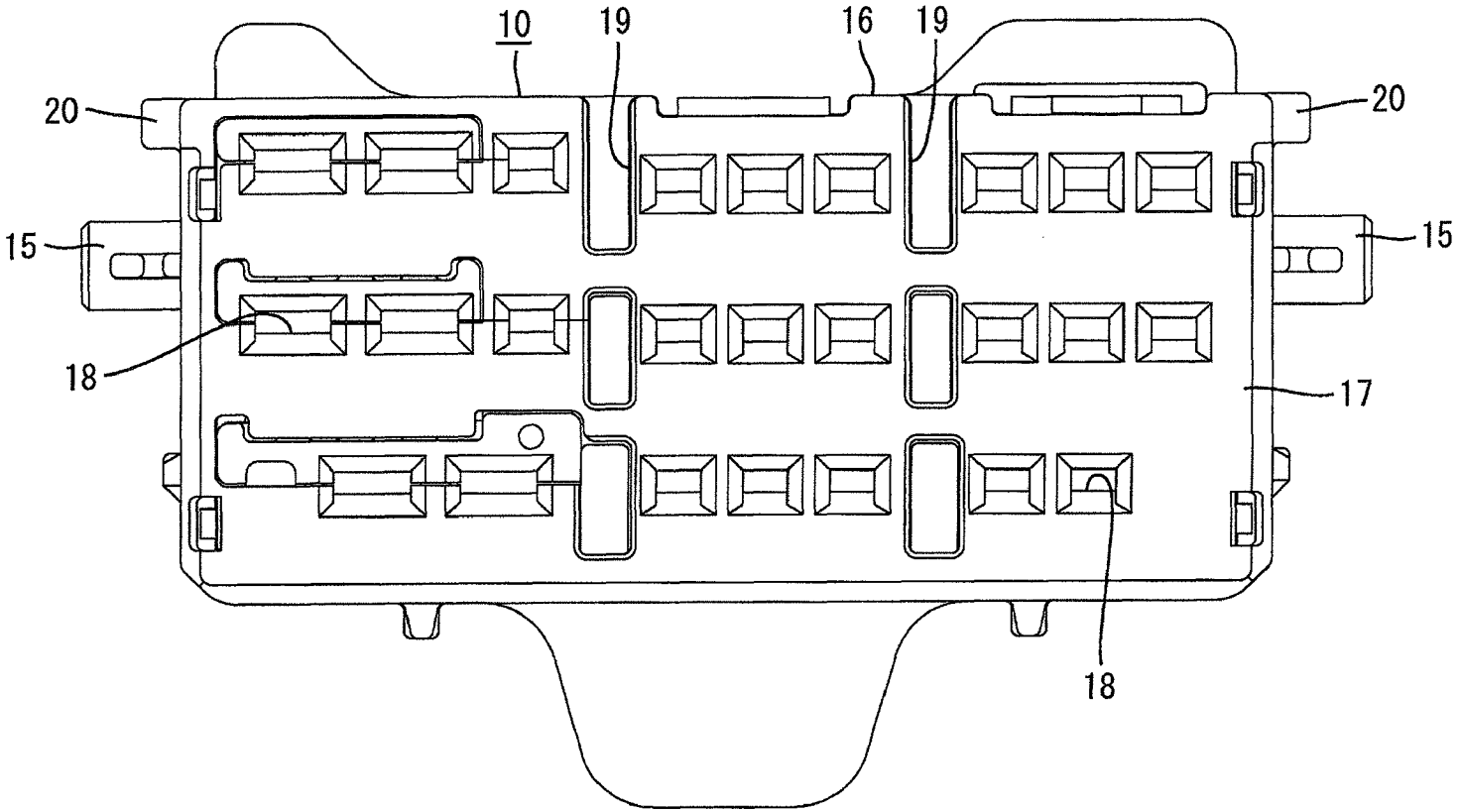
FIG. 10 is a front view of the female connector.

A front retainer 16 is mounted on a front surface of the female housing body 11, as shown in FIG. 10. The front retainer 16 includes a front wall 17 that covers the front surface of the female housing body 11. Insertion holes 18 are formed in the front wall 17 and communicate with the respective cavities 12. The tabs 93 are aligned with and inserted in the respective insertion holes 18 from the front. Fitting grooves 19 extend vertically on the front wall 17 and the female housing body 11 between the respective insertion holes 18 and between the respective cavities 12.

Left and right restrictions 20 project on upper corners of the front wall 17. The restrictions 20 are substantially columnar and are smaller than the cam follower 15. Deflection restricting members 21 project from a rear surface of the front wall 17 at positions corresponding to the respective lances 13 and can enter the deflection spaces 14. The front retainer 16 is movable longitudinally between a temporary engaging position at which the front wall 17 is forward of the front surface of the female housing body 11 and a true engaging position at which the front wall 17 contacts the front surface of the female housing body 11. The deflection restricting members 21 are retracted from the deflection spaces 14 at the temporarily engaging position so that the female terminal fittings 80 can be inserted into the cavities 12. However, the deflection restricting members 21 enter the deflection spaces 14 and restrict deflection of the lances 13 at the true engaging position for doubly preventing removal of the female terminal fittings 80.

Figure 7:
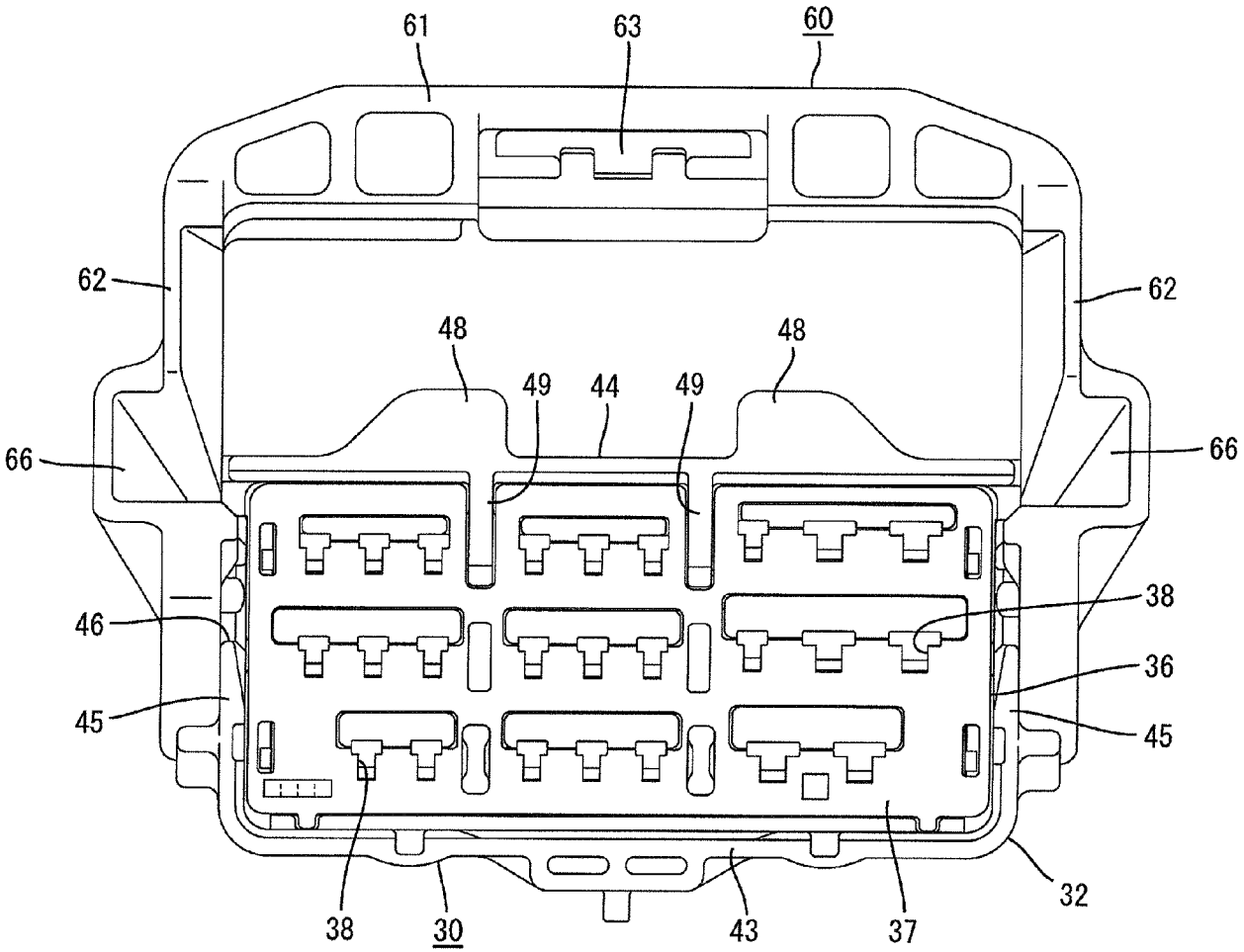
FIG. 7 is a front view of the male connector.
Figure 8:
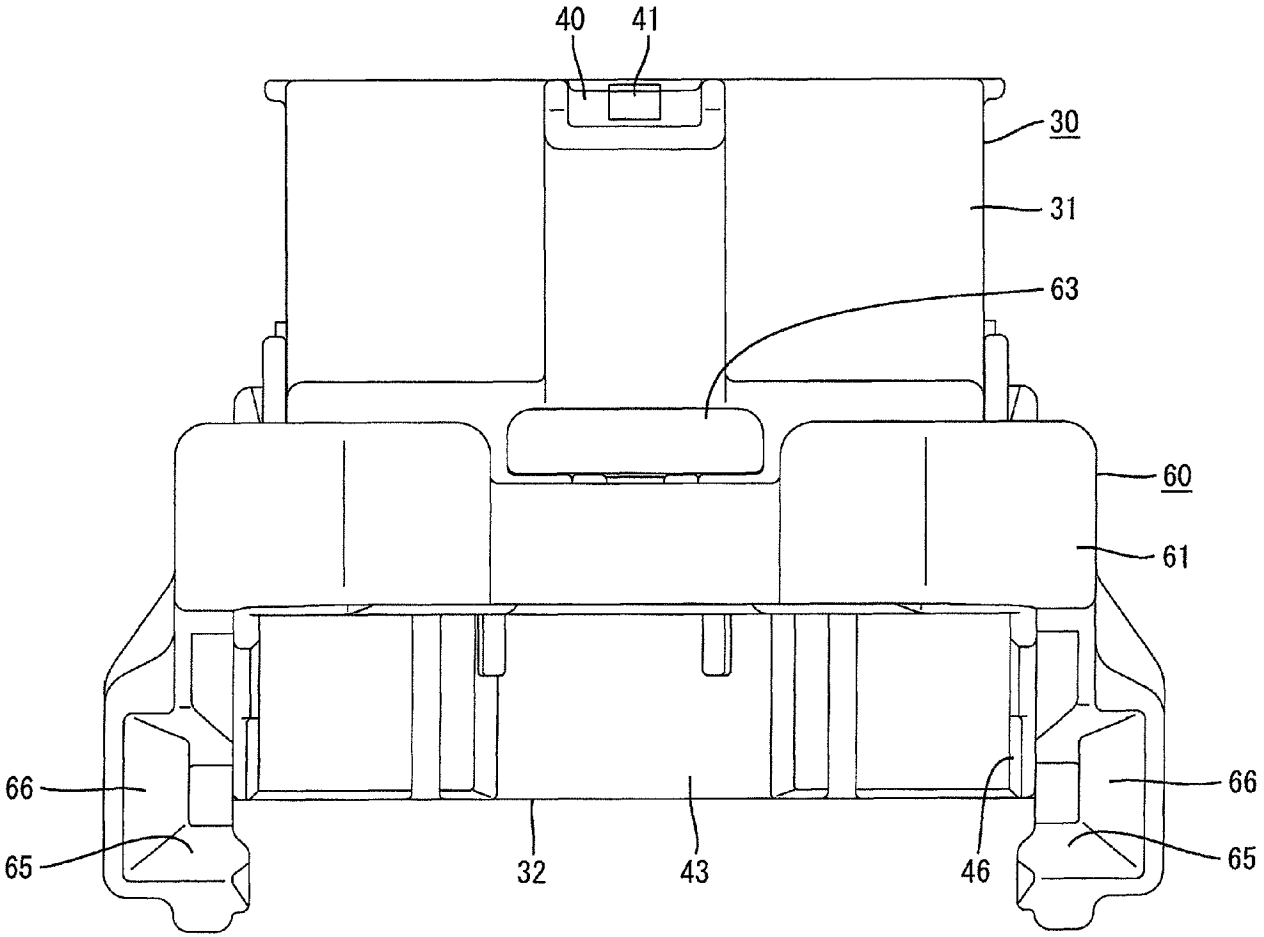
FIG. 8 is a plan view of the male connector.

The male housing 30 is made of a synthetic resin and has a quadrangular block-shaped male housing body 31, as shown in FIGS. 7 and 8. A quadrangular hood 32 projects forward from a front of the male housing body 31. Cavities 33 extend longitudinally through the male housing body 31, as shown in FIG. 6. A deflectable lance 34 projects forward in each cavity 33 and a forwardly open deflection space 35 is formed below each lance 34. The male terminal fittings 90 are inserted into the cavities 33 from the rear, and the lances 34 prevent removal of the properly inserted male terminal fitting 90.

The male terminal fitting 90 is formed by bending or otherwise forming a unitary conductive metal plate. The male terminal fitting 90 includes a quadrangular sleeve-shaped body 91, a barrel 92 contiguous with a rear end of the body 91, and a tab 93 that is contiguous with a front end of the body 91. The barrel 92 is connected to an end portion of an electric wire W2 by caulking, and the electric wire W2 is guided to the outside of the male housing body 31 from a rear end opening of the cavity 33. A lance hole 94 is formed on the body 91 and can receive a part of the lance 34. Engagement of the lance 34 with a front end of the lance hole 94 restricts removal of the male terminal fitting 90 from the cavity 33. The tab 93 projects forward from the front surface of the male housing body 31 into the hood 32.

A front retainer 36 is mounted on a front surface of the male housing body 31 from a front side. The front retainer 36 includes a front wall 37 which covers a front surface of the male housing body 31. Through holes 38 which are communicated with the respective cavities 33 are formed in the front wall 37 as openings, and the tabs 93 are aligned with and are inserted into the respective through holes 38 from a rear side.

Deflection restricting members 39 project from a rear surface of the front wall 37 at positions corresponding to the respective lances 34 and can enter the deflection spaces 35. The front retainer 36 is movable longitudinally between a temporary engaging position at which the front wall 37 is spaced forward from the front surface of the male housing body 31 and a true engaging position at which the front wall 37 is in contact with the front surface of the male housing body 31. The deflection restricting members 39 are retracted from the deflection spaces 35 at the temporary engaging position so that the male terminal fittings 90 can be inserted into the cavities 33. However, the deflection restricting members 39 enter the deflection spaces 35 and restrict deflection of the lances 34 at the true engaging position for doubly preventing removal of the male terminal fittings 90. The entire front retainer 36 is inside the hood 32 at both the temporary engaging position and the true engaging position. A lock receiving portion 40 projects from a rear end of a widthwise center portion of the male housing body 31 and can hold a lever 60. A lock pawl 41 projects rearward on the lock receiving portion 40.

The hood 32 is larger than the male housing body 31 with a step 42 between the hood 32 and the male housing body 31. The hood 32 includes a bottom plate 43, a top plate 44 above the bottom plate 43, and left and right side plates 45 that are contiguous with both edges of the bottom plate 43 and the top plate 44.

A cutaway portion 46 is formed by an opening in an upper portion of the hood 32. More specifically, the cutaway portion 46 is cut away at a substantially front half of the top plate 44 throughout the entire width and also is away at substantially front upper halves of the side plates 45 in a substantially L shape. The cutaway portion 46 formed in the top plate 44 is arranged slightly in front of a distal end of the tab 93. The female housing 10 is fit into the hood 32 through an open face of the cutaway portion 46 from above and is brought into contact with and is received by an inner surface of the bottom plate 43. Thus, the female housing 10 is stopped temporarily at an assembled position where both the female and male terminal fittings 80, 90 face each other. Thereafter, the female housing 10 deeply enters the hood 32 due to displacement of the lever 60 and arrives at the fitting position where the terminal fittings 80, 90 are connected properly.

Figure 5:
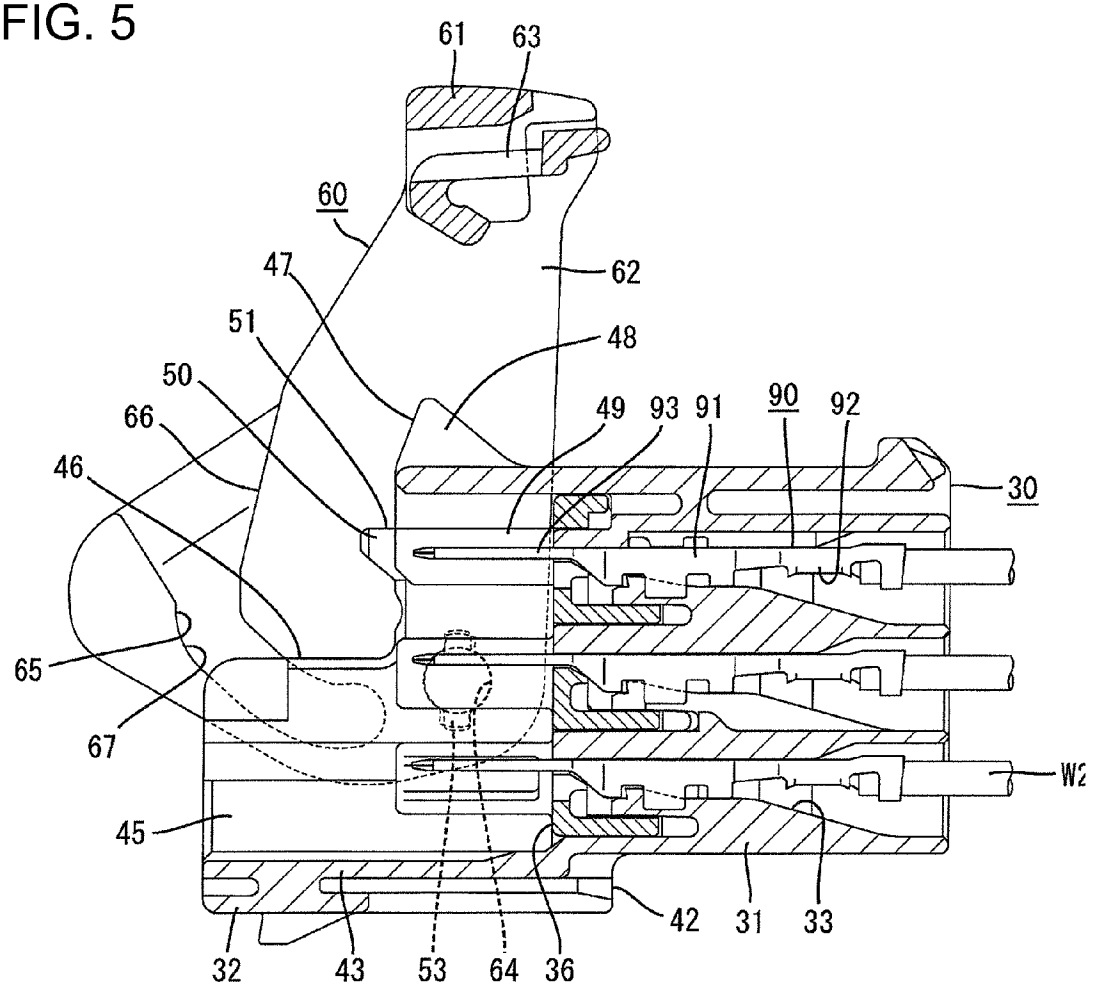
FIG. 5 is a cross-sectional view of a male connector.

Left and right guides 48 project from a front end of an outer surface of the top plate 44 at a position facing the cutaway portion 46, as shown in FIG. 5. Each guide 48 includes an inclined surface 47 inclining up toward the rear. The female housing 10 may be displaced toward the top plate 44 during assembly. However, the female housing 10 slides on the inclined surfaces 47 of the guides 48 and into the hood 32. Fitting members 49 project from a front end portion of an inner surface of the top plate 44 and enter the fitting grooves 19 in a fitting engagement step of the housings 10, 30. The fitting members 49 are formed on the top plate 44 throughout the entire length of the top plate 44.

Figure 1:
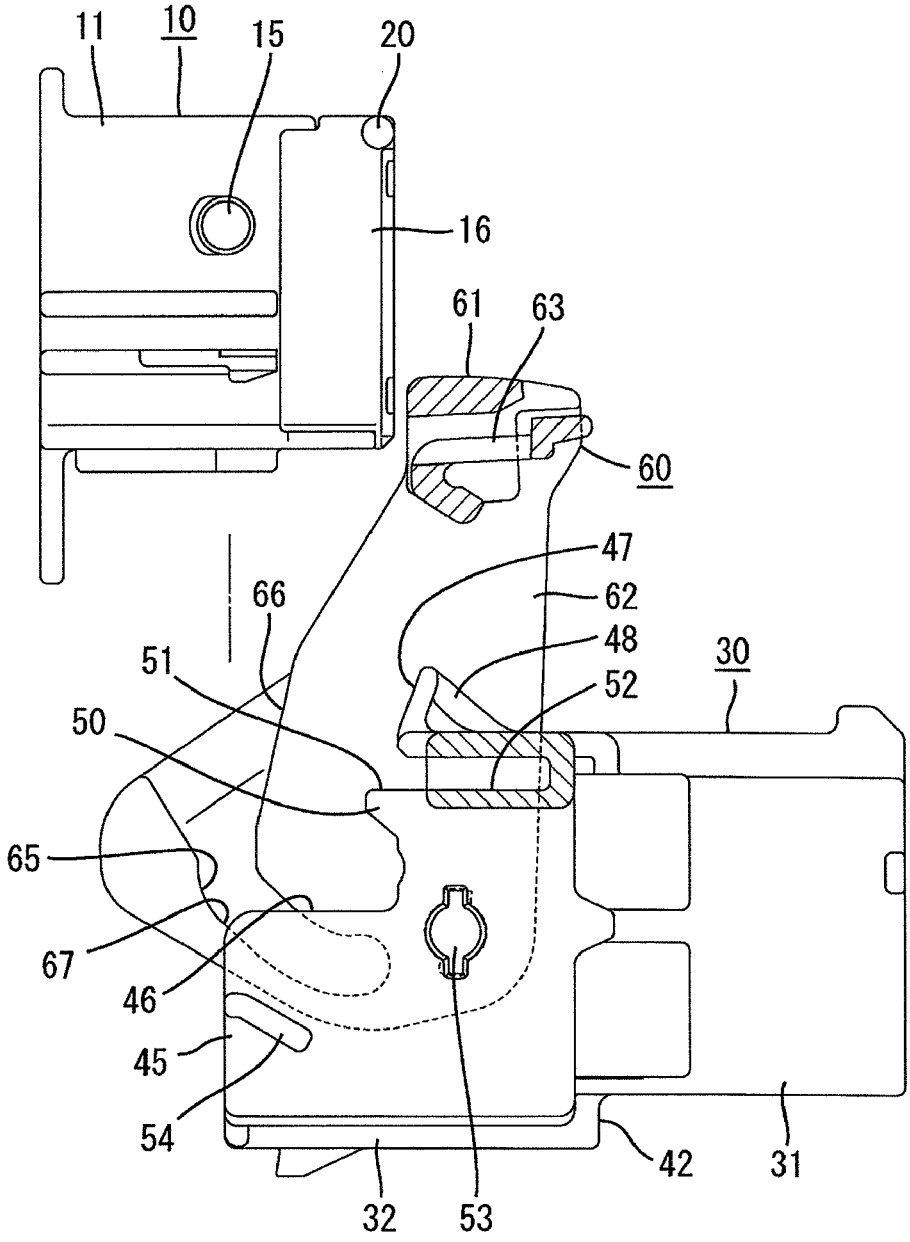
FIG. 1 a side view, partly in section, of a connector according to the invention showing a state before both housings are assembled.

Left and right interference portions 50 project forward from positions above the cutaway portions 46 of both side plates 45. Each interference portion 50 includes an interference surface 51 that is flat along the longitudinal direction and is formed within a thickness of the respective side plate 45. The restricting portions 20 contact the interference surfaces 51 of the interference portions 50 when the female housing 10 is assembled in a slightly inclined posture, so that further assembly is restricted. Bottomed guide grooves 52 are formed on inner surfaces of both side plates 45, as shown in FIG. 1, and extend continuously in the longitudinal direction from the interference surfaces 51 of the interference portions 50. The restricting portions 20 slide on surfaces of the guide grooves 52 as the female housing 10 moves from the assembled position to the fitting position.

Left and right support shafts 53 project from the side plates 45 near the corners of the cutaway portions 46 of the side plates 45. The support shafts 53 have columnar shapes and can pivotally support the lever 60. Left and right stoppers 54 are formed on the side plates 45 below the cutaway portions 46. The stoppers 54 are ribs that incline down from a front end to a rear end and can interfere with the lever 60.

The lever 60 is made of a synthetic resin, and as shown in FIG. 7, has a manipulation part 61 that extends in the widthwise direction. Left and right parallel arms 62 project from ends of the manipulation part 61 so that the lever 60 defines a U-shape. A deflectable lock 63 is cantilevered rearward from a center portion of the manipulation part 61 in the widthwise direction. A front part of the lock 63 is covered by an upper surface of the manipulation part 61 to prevent inadvertent manipulation of the lock 63. As shown in FIG. 5, left and right bearings 64 penetrate the arms 62. A support shaft 53 penetrates the bearings 64 and is supported by the bearings 64. Left and right bottomed cam grooves 65 are formed on inner surfaces of the arms 62. Each cam groove 65 has a guide portion 66 at an entrance side of the cam groove 65 and gradually widens toward an outer periphery of the arm 62. An action area 67 extends from an end of the guide portion 66 toward a bearing 64 side. A cam follower 15 is inserted through the guide portion 66 of the cam groove 65 when assembling the female housing 10.

The lever 60 is rotatably displaced about the support shafts 53 between an initial position and a fitting position. The lever 60 extends vertically at the initial position so that the outer periphery of the arm 62 contacts the stopper 54 to restrict frontward tilting of the lever 60 and so that the manipulation part 61 is above the cutaway portion 46. The guide 66 of the cam groove 65 opens upwardly at the initial position, and a rear edge of the guide 66 extends substantially vertically. On the other hand, the lever 60 extends laterally at the fitting position so that the lock 63 engages the lock pawl 41 of the lock receiving portion 40 and the manipulation part 61 follows a rear end portion of the male housing 30.

Figure 2:
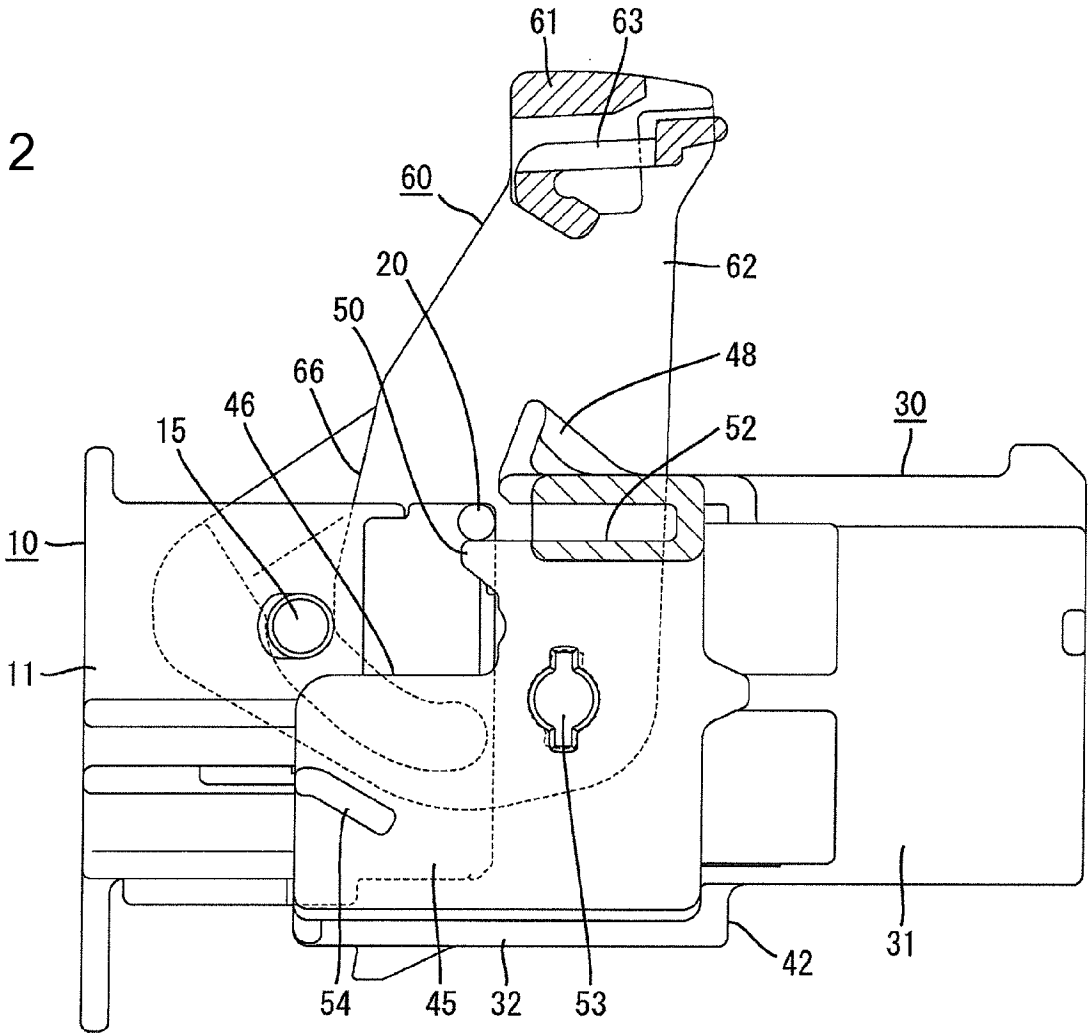
FIG. 2 is a side view, partly in section, of the connector when the housings initially are assembled.

The female terminal fittings 80 are inserted into the female housing body 11 and then the front retainer 16 is brought into the true engaging position. Similarly, the male terminal fittings 90 are inserted into the male housing body 31 and then the front retainer 36 is brought into the true engaging position. The lever 60 is held at the initial position with respect to the male housing 30 so that an open face of the cutaway portion 46 is opened in the vertical direction, and the entrance of the guide 66 of the cam groove 65 also is opened in the upward direction, as shown in FIG. 1. The female housing 10 then is pulled down with respect to the hood 32 in a direction perpendicular to the fitting direction and into the assembled position shown in FIG. 2. In this assembling process, the cam follower 15 enters the guide 66 of the cam groove 65 from above in a loosely fitted state. A gap between the groove surface of the guide 66 and the cam follower 15 gradually narrows in the direction toward the assembled position so that the gap is large at an entrance of the guide 66 and small at an end. A lower surface of the female housing 10 contacts an inner surface of the bottom plate 43 when the female housing 10 reaches the assembled position of FIG. 2 to prevent further downward movement of the female housing 10. The cam followers 15 reach the end of the guides 66, the tabs 93 of the male terminal fittings 90 are arranged in front of the female terminal fittings 80, and the restrictions 20 face the guide grooves 52 while being supported on the interference portions 50.

Figure 3:
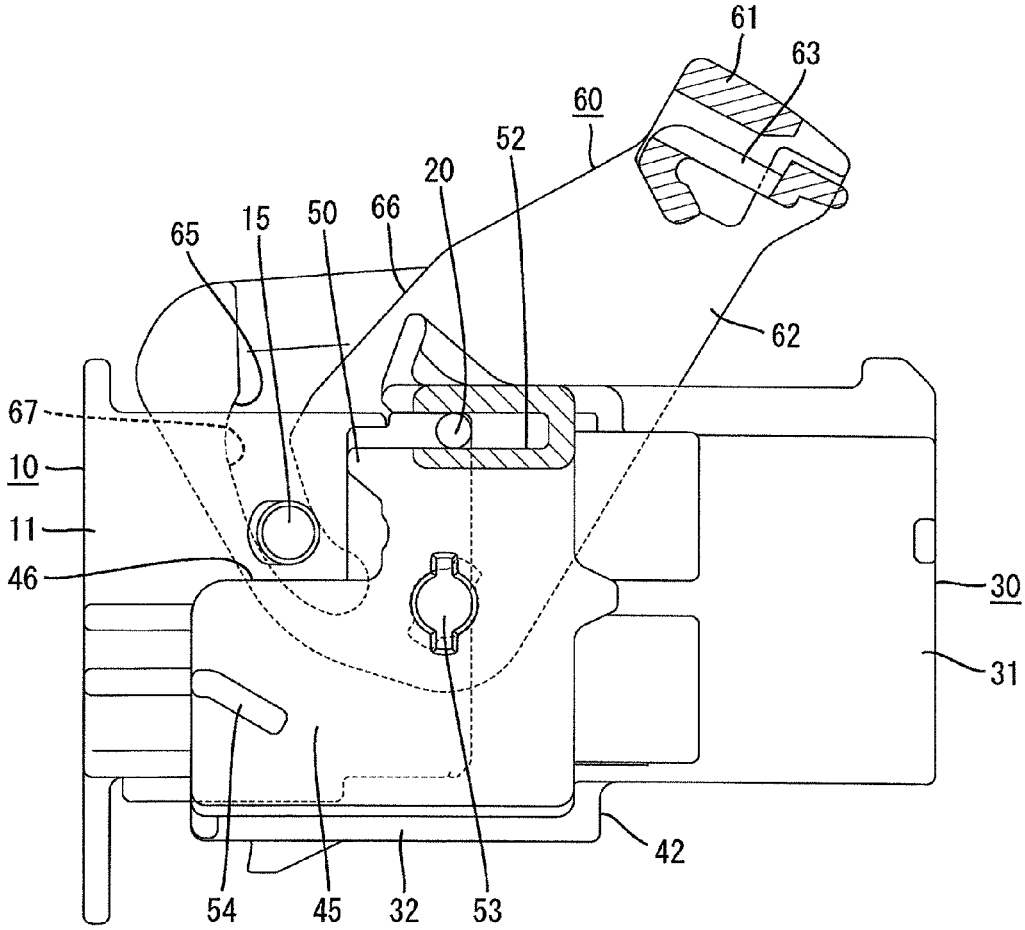
FIG. 3 is a side view, partly in section, of the connector with the housings halfway toward a fitting position.
Figure 4:
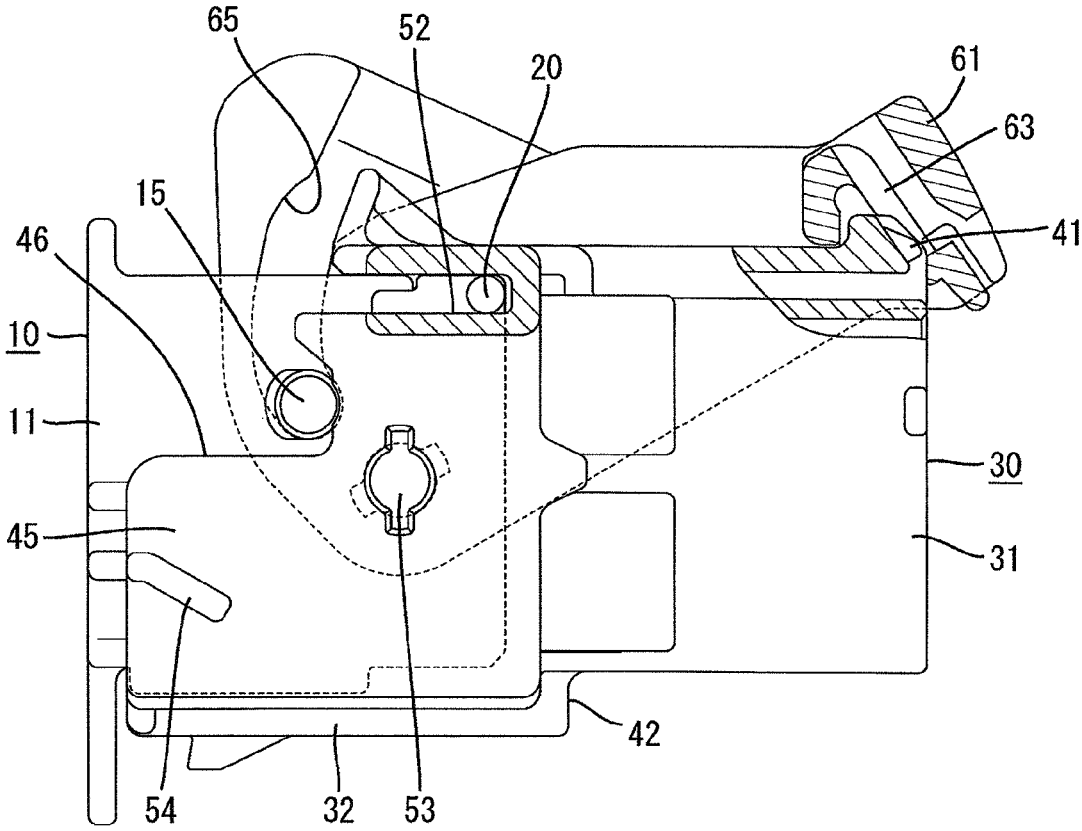
FIG. 4 is a side view, partly in section, of the connector with the housings in the fitting position.

The lever 60 then is rotated toward the fitting position, as shown in FIG. 3. As a result, the cam followers 15 slide on groove surfaces of the action portions 67 of the cam grooves 65 so that a cam action is exerted between the lever 60 and the female housing 10 to urge housings 10, 30 toward one another. Thus, the female housing body 11 approaches the male housing body 31. During this fitting engagement operation, the restrictions 20 move along the guide grooves 52 and simultaneously, the fitting members 49 move along the fitting grooves 19 to guide the fitting engagement operation of the female housing 10. The lock 63 engages with the lock receiving portion 40 when the lever 60 and the female housing 10 reach the fitting position shown in FIG. 4. Hence the rotational operation of the lever 60 is restricted and the housings 10, 30 are held at a removal restricting state. The cam followers 15 reach ends of the action portions 67 of the cam grooves 65, and the restrictions 20 reach ends of the guide grooves 52.

Figure 11:
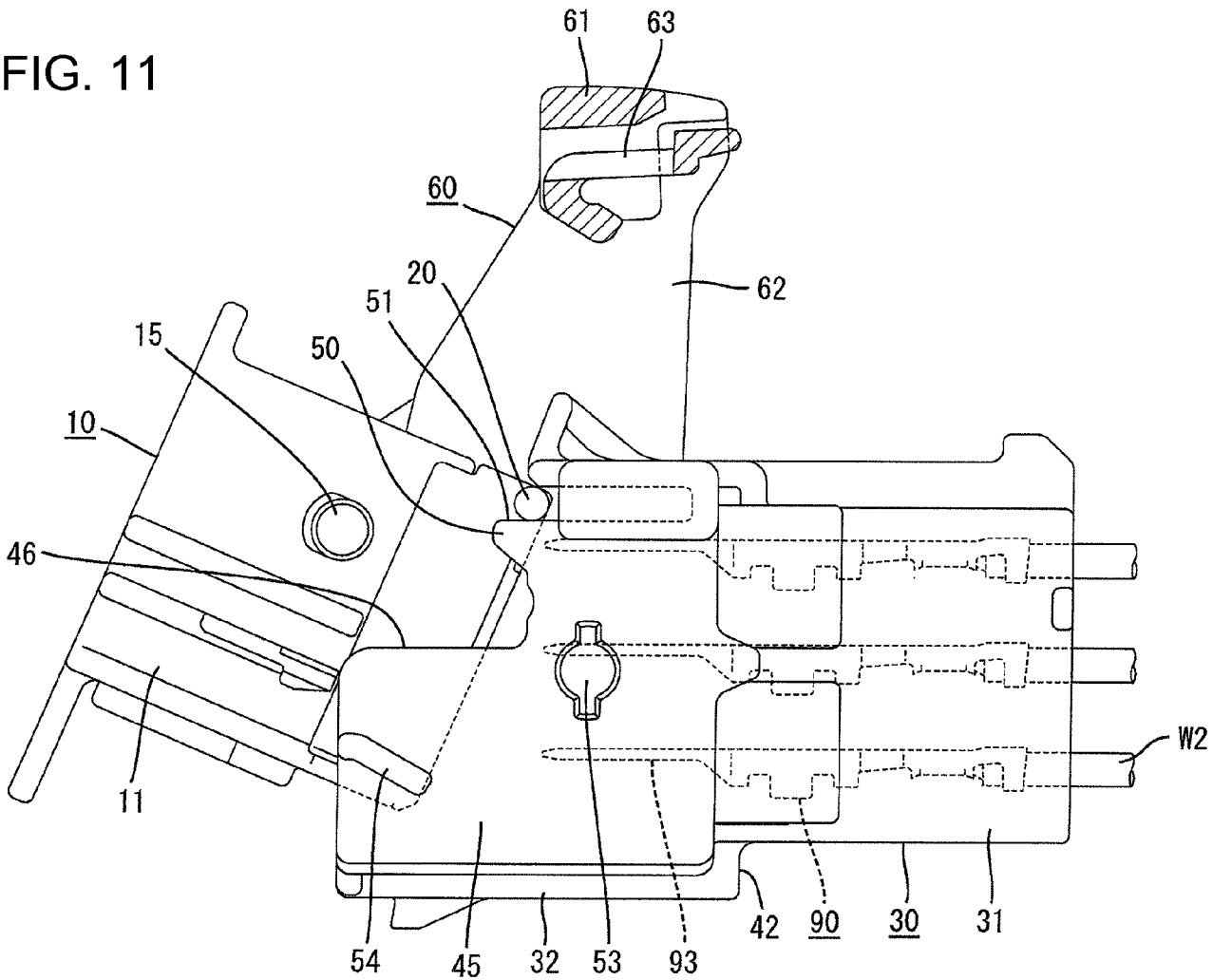
FIG. 11 is a side view of the connector in a state where the female housing in an inclined posture interferes with the male housing.

The female housing 10 may be inclined forwardly from a normal assembled posture during assembly. There is a concern that the distal end of the tab 93 will interfere with an upper portion of a front end of the female housing 10 and break or damage the tab 93 due to the formation of the cutaway portions 46 in the hood 32. However, according to this embodiment, in an attempt to assemble the female housing 10 with the above-mentioned inclined posture, the restrictions 20 contact the interference portions 50, as shown in FIG. 11, to prevent the female housing 10 from interfering with the distal end of the tab 93. Thereafter, the posture of the female housing 10 is adjusted while maintaining contact between the restriction 20 and the interference portion 50 to guide the female housing 10 to the assembled position.

As explained above, the entrance of the guide 66 of the cam groove 65 is directed up and perpendicular to the fitting direction of the housings 10, 30 when the lever 60 is at the initial position, and the assembling direction of the female housing 10 with respect to the hood 32 also is perpendicular to the fitting direction of the housings 10, 30. Accordingly, a large assembling space is unnecessary in front of the male housing 30 in the fitting direction of the housings 10, 30 so that space efficiency is enhanced.

The hood 32 is formed with the cutaway portion 46 that opens toward the assembling side of the female housing 10 and the bottom plate 43 that receives the female housing 10 in a contacting manner is formed on the hood 32 at a position where the bottom plate 43 faces an open face of the cutaway portion 46 of the hood 32. Thus, it is possible to prevent the connector from becoming large in the fitting direction and the connector exhibits excellent space saving property.

The restriction 20 contacts the interference portion 50 to restrict fitting engagement of the female housing 10 into the hood 32 in an inclined posture, thereby preventing damage to the tab 93.

The restriction 20 slides on the guide groove 52 while fitting the housings 10, 30 together, thereby ensuring a smooth fitting engagement operation. Accordingly, the female housing 10 is simplified as compared to a case where a dedicated guide means is provided in addition to the restriction 20.

The lever 60 is arranged in a raised manner to project up from the female housing 10 and the entrance of the cam groove 65 is directed up in the projecting direction of the lever 60 when the lever 60 is at the initial position. Thus, a space on the projecting side of the lever 60 is used efficiently.

The invention is not limited to the above described and illustrated embodiment. For example, the following embodiments are also embraced by the scope of the invention as defined by the claims.

The entrance of the guide portion of the cam groove may be arranged to be directed in a direction inclined with respect to the fitting direction or a direction perpendicular to the fitting direction when the lever is in the initial position.

The lever may be a slide lever mounted on the first housing in a linearly slidable manner between the initial position and the fitting position, and when the slide lever is at the initial position, the entrance of the cam groove of the slide lever may be aligned to intersect the fitting direction of the housings.

The cutaway portion may be formed by cutting away the whole top plate of the hood.

The cutaway portion may be formed by cutting away the whole both side plates of a hood.

The cutaway portion may be formed by cutting away only the top plate of the hood.

What is claimed is:

1. A lever connector comprising:

first and second housings that are engageable with each other by fitting engagement, the first housing having a hood that allows insertion of the second housing therein, a cutaway portion being formed in the hood and opening toward an assembling side of the second housing and a receiving portion that receives the second housing in a contacting manner being formed on the hood at a position where the receiving portion faces an open face of the cutaway portion of the hood; and a lever mounted on the first housing for displacement between an initial position and a fitting position, a cam groove formed on the lever, a cam follower formed on the second housing, the cam follower being introduced into the cam groove from an entrance of the cam groove by bringing the first and second housings into slight fitting engagement while holding the lever at the initial position, and the cam follower being moved slidably on a groove surface of the cam groove by displacing the lever toward the fitting position in a state where the cam follower is introduced into the cam groove so that the first and second housings are brought into a normal fitting position due to a cam action exerted by the slide movement of the cam follower, wherein the entrance of the cam groove is aligned in a direction that intersects the fitting direction of the first and second housings when the lever is at the initial position.

2. The lever connector of claim 1, wherein a tab of a male terminal projects in the inside of the hood, a restriction projecting on the second housing, and an interference portion being formed on the cutaway portion so that in a state where the second housing assumes a posture inclined from a normal assembled posture, the restriction contacts the interference portion to restrict fitting engagement of the second housing in the inclined posture into the inside of the hood.

3. The lever connector of claim 2, wherein a guide groove is formed on the hood at a position contiguous with the interference portion and extends in the fitting direction, and the restriction is moved slidably on the guide groove in the fitting engagement process of the first and second housings.

4. A lever connector of, comprising:

first and second housings that are engageable with each other by fitting engagement; and a lever mounted on the first housing for displacement between an initial position and a fitting position, a cam groove formed on the lever, a cam follower formed on the second housing, the cam follower being introduced into the cam groove from an entrance of the cam groove by bringing the first and second housings into slight fitting engagement while holding the lever at the initial position, and the cam follower being moved slidably on a groove surface of the cam groove by displacing the lever toward the fitting position in a state where the cam follower is introduced into the cam groove so that the first and second housings are brought into a normal fitting position due to a cam action exerted by the slide movement of the cam follower, wherein the entrance of the cam groove is aligned in a direction that intersects the fitting direction of the first and second housings when the lever is at the initial position and wherein the lever is arranged in a raised manner to project from the first housing and the entrance of the cam groove is aligned toward a lever projecting side when the lever is at the initial position.

5. The lever connector of claim 4, wherein the first housing has a hood that allows insertion of the second housing therein, a cutaway portion being formed in the hood and opening toward an assembling side of the second housing and a receiving portion that receives the second housing in a contacting manner being formed on the hood at a position where the receiving portion faces an open face of the cutaway portion of the hood.

6. The lever connector of claim 5, wherein a tab of a male terminal projects in the inside of the hood, a restriction projecting on the second housing, and an interference portion being formed on the cutaway portion so that in a state where the second housing assumes a posture inclined from a normal assembled posture, the restriction contacts the interference portion to restrict fitting engagement of the second housing in the inclined posture into the inside of the hood.

7. The lever connector of claim 6, wherein a guide groove is formed on the hood at a position contiguous with the interference portion and extends in the fitting direction, and the restriction is moved slidably on the guide groove in the fitting engagement process of the first and second housings.

* * * * *